United States Patent [19]

Takajo et al.

[11] Patent Number: 4,954,171

[45] Date of Patent: Sep. 4, 1990

[54] COMPOSITE ALLOY STEEL POWDER AND SINTERED ALLOY STEEL

[75] Inventors: Shigeaki Takajo; Osamu Furukimi; Kuniaki Ogura; Keiichi Maruta; Teruyoshi Abe; Ichio Sakurada, all of Chiba, Japan

[73] Assignee: Kawasaki Steel Corp.

[21] Appl. No.: 381,652

[22] PCT Filed: Sep. 30, 1988

[86] PCT No.: PCT/JP88/01007

§ 371 Date: Jul. 14, 1989

§ 102(e) Date: Jul. 14, 1989

[87] PCT Pub. No.: WO89/02802

PCT Pub. Date: Apr. 6, 1989

[30] Foreign Application Priority Data

Sep. 30, 1987 [JP] Japan ..... 62-244074
Jun. 6, 1988 [JP] Japan ..... 63-137400

[51] Int. Cl.[5] ..... C22C 1/00

[52] U.S. Cl. ..... 75/246; 75/255; 148/126.1; 148/127; 148/143; 419/23; 419/35; 428/570; 420/119

[58] Field of Search ..... 75/246, 25; 428/570; 419/35, 23; 148/126.1, 127, 143

[56] References Cited

U.S. PATENT DOCUMENTS 3,887,402 6/1975 Kondo et al. ..... 148/126
3,901,661 8/1975 Kondo et al. ..... 29/182
4,655,853 4/1987 Byrnes et al. ..... 148/16.5

FOREIGN PATENT DOCUMENTS 61-130401 6/1986 Japan .
63-18001 1/1988 Japan .

*Primary Examiner*—Stephen J. Lechert, Jr.
*Assistant Examiner*—Nina Bhat
*Attorney, Agent, or Firm*—Austin R. Miller

[57] ABSTRACT

Provided herein are high-strength high-toughness sintered alloy steel and composite alloy steel powder useful for the production thereof. The sintered alloy steel contains, as the alloy components in the final product, Ni, Mo, and/or W, and C, if necessary, said alloy being composed of 0.50–3.50 wt % of Ni, 0.65–3.50 wt % of Mo+½W, (and 0.3–0.8 wt % of C, if necessary), and the remainder of Fe and inevitable impurities, and has a density higher than 7.0 g/cm$^3$ and a tensile strength higher than 130 kgf/mm$^2$ after quenching and tempering. The composite alloy steel powder is composed of iron powder particles and powdery alloy components attached by diffusion to part of the surface of the iron powder particles, with the content of Ni and the content of Mo+½W in the steel powder of particle diameter smaller than 45 ∞m being in the range of 2.0–4.2 times the average content in the entire steel powder. The sintered alloy steel has high strength and high toughness despites its comparatively low alloy composition and can be produced without any special equipment. The heat-treated sintered steel meets the requirements for automotive parts and the like.

15 Claims, 2 Drawing Sheets

COMPOSITE ALLOY STEEL POWDER AND SINTERED ALLOY STEEL

Technical Field

The present invention relates to an alloy powder to be used for the production of sintered parts by powder metallurgy and also to a high-strength sintered alloy steel to be produced by heat treatment after sintering.

Background art

Iron-based sintering materials are in general use for automotive parts and others. Recently, these parts are required to be lighter and stronger than before.

It is known that various kinds of alloy steel powders are used to produce sintered parts having high strength. More often than not these high-strength sintered parts are required to have a high density. To meet this requirement, attempts are being made to increase the compressibility of steel powder by using steel powder in the form of composite alloy steel powder which is produced by attaching by diffusion powder particles of alloy elements to part of the surface of iron powder particles, because the particles of completely uniform alloy steel powder are hard Even in the case of these composite alloy steel powders, it is impossible to obtain sintered bodies having satisfactory properties unless the alloy composition thereof is adequate or unless they are prepared and used adequately.

An attempt to increase the strength of sintering materials by increasing the amount of the alloying element has been made according to Japanese Patent Laid-open No. 231102/1986. A disadvantage of such high alloy steel (containing more than 7% of Ni) is that it is high in production cost and it has such high hardness after sintering that it does not permit sizing and cutting. An additional disadvantage is that it contains a large amount of residual austenite after sintering. This makes it necessary to perform special heat treatment such as sub-zero treatment if a high strength (in terms of tensile strength higher than 130 kgf/mm$^2$) is to be obtained. This leads to a cost increase. In addition, the residual austenite decomposes with the lapse of time, causing the deformation of parts.

There is disclosed in Japanese Patent Publication No. 9649/1970 a low alloy steel powder which provides high-strength sintered bodies which undergo less dimensional changes during heat treatment performed after molding. This low alloy steel powder is obtained by heating a mixture of iron powder and compounds of Ni, Mo, and Cu, thereby attaching by diffusion the alloy components, crushing agglomerated particles, and annealing thus obtained particles. A disadvantage of this low alloy steel powder is that it contains 0.50–2.00 wt. % of Cu, which segregates on the grain boundary, forming an $\epsilon$-Cu brittle layer, which aggravates the mechanical properties.

One of the present inventors proposed a composition for composite alloy steel powder which is suitable in the case where the sintered body is used as such without any post heat-treatment. (See Japanese Patent Laid-open No. 89601/1988.) This alloy steel powder contains Ni and/or Cu and Mo, and the alloy composition imparts high hardness and dimensional stability to the sintered body. However, it does not afford any sintered body which has a tensile strength higher than 130 kgf/mm$^2$.

Further, one of the present inventors and another proposed a composite alloy steel powder composed of steel powder and two or more alloy components attached by diffusion to the surface of the steel powder particles, with the content of each alloy component in the steel powder of particle diameter smaller than 44 $\mu$m being in the range of 0.9–1.9 times the average content in the entire steel powder (See Japanese Patent Laid-open No. 130401/1986.) This alloy steel powder, however, does not provide any sintered body which has a tensile strength higher than 130 kgf/mm$^2$. This is because the sintered body does not undergo strain-induced transformation from austenite to martensite when it is pulled, and it does not have a high density due to insufficient compressibility.

Sintered parts are given high internal toughness, high surface abrasion resistance, and high fatigue strength by carburizing quenching. Therefore, they exhibit their great practical value when used as high-strength parts such as gears. However, it is difficult to obtain high strength (in terms of tensile strength higher than 130 kgf/mm$^2$) by the simple carburizing quenching of conventional sintered bodies.

One reason for this is that the sintered body has pores and hence undergoes carburizing in a different manner from ordinary steel, with the result that the carbon concentration is not adequately distributed. This leads to insufficient strength. To eliminate this disadvantage, attempts were made to carry out carburizing after the density of the sintered body had been sufficiently increased An example of such attempts is sintering-forging. It provides high-strength materials. This process, however, has only a limited application area on account of its high cost attributable to special equipment and dies for hot forging which have a short life.

On the other hand, an attempt was made to increase the density of the sintered body to 7.6–7.8 g/cm$^3$ by cold forging or coining, thereby to obtain a high-strength material. (See Japanese Patent Publication No. 16325/1974.) An advantage of this process is that it dispenses with equipment for hot forging. This advantage is offset by a disadvantage that the die has a short life because the cold forging or coining needs a high pressure.

There are many instances where the high strength of heat-treated sintered body is achieved by using high alloys and increasing the density. However, the heat-treated sintered body disclosed in Japanese Patent Laid-open No. 146203/1987 has a tensile strength lower than 120 kgf/mm$^2$. Thus the requirement for higher strength than that is not fulfilled.

There is disclosed in Japanese Patent Laid-open No. 50409/1979 a process for producing a heat-treated sintered body having a density of 7.6 g/cm$^3$, thereby achieving a tensile strength of 160 kgf/mm$^2$. This sintered body, however, is low in toughness, with an impact value lower than 2.5 kgf.m/cm$^2$.

In view of the ever increasing demand for sintered parts having high strength, the heat treatment after sintering is becoming important more and more. After heat treatment, the sintered body becomes so hard that it is difficult to correct its dimensions by machining or sizing. Thus machining and sizing should be performed prior to heat treatment. For easy machining or sizing, it is necessary that the sintered body should have a low hardness (hence a low strength) before heat treatment and have a high hardness (hence a high strength) after heat treatment.

No careful consideration has been given to conventional composite alloy steel powders as to the specification suitable for the above-mentioned processing. Thus the advent of a new alloy steel powder that meets this requirement has long been awaited.

It is an object of the present invention to provide a composite alloy steel powder for powder metallurgy and heat treated sintered steel which afford sintered alloy steel of high strength and high toughness despite its comparatively low alloy composition, without the necessity for high alloy composition and special equipment. Thus the present invention realizes mutually contradictory technologies machining or sizing the sintered body easily before heat treatment and imparting high strength and high toughness to the sintered body after heat treatment.

Disclosure of the Invention

The present inventors carried out extensive studies on how to increase the strength and toughness of sintered bodies. As the result, it was found that the strength and toughness of sintered bodies are greatly affected by the composition of steel powder and the density of sintered bodies.

The present inventors noticed that what is important in the case of Ni-Mo series composite alloy powders is to establish an adequate composition when the sintered body undergoes carburizing quenching. Since carburizing quenching is a process designed to perform hardening while causing carbon to diffuse into sintered steel of low carbon, the sintered body should have a composition of low-carbon alloy steel if it is to have the capability of machining and sizing before heat treatment, and, after heat treatment, the sintered body should contain a proper amount of carbon so that it has a desired strength.

The present inventors found that Mo is less liable than Ni to make the sintered body hard in the absence of carbon. Therefore, it is possible to increase the amount of Mo more freely than the amount of Ni without adverse effect on the machining and sizing of the sintered body before heat treatment. On the other hand, Mo contributes more than Ni to the increase of strength after carburizing. With this in mind, the present inventors expected that very good results would be obtained if the composition of the conventional Ni-Mo series composite alloy steel powders is modified such that the amount of Mo is much greater than the amount of Ni. (The composition includes the one in which Mo is replaced by W.)

The present inventors carried out experiments as mentioned in the following to see how the strength and toughness of the sintered body are related with the composition and density of the sintered body.

Three kinds of composite alloy steel powders were prepared which are different in the content of Ni and Mo as shown below.

(X) 0.58% Ni - 3.21% Mo
(Y) 1.07% Ni - 3.42% Mo
(Z) 1.09% Ni - 0.6% Mo

The composite steel powders were incorporated with graphite and lubricant (zinc stearate) and then underwent preliminary sintering. Subsequently, they were compressed at different pressures to give green compacts having different densities.

The green compacts underwent sintering (at 1250° C. for 30 minutes in an ammonia decomposition gas), followed by oil quenching (after heating at 870° C. for 60 minutes in an inert gas) and tempering at 180° C. for 60 minutes. The resulting sintered bodies had the tensile strength and Charpy impact value which vary according to the density as shown in FIGS. 1 and 2. It is noted that the sintered bodies of compositions (X) and (Y) have a high tensile strength (higher than 130 kgf/mm$^2$) and high toughness when the density is higher than 7.0 g/cm$^3$. In addition, it is also noted that the tensile strength exceeds 150 kgf/mm$^2$ when the density is higher than 7.3 g/cm$^3$.

The present invention was completed on the basis of the above-mentioned findings. The gist of the present invention resides in alloy steels and alloy steel powders for sintering as defined in the following.

(1) A composite alloy steel powder for powder metallurgy composed of iron powder particles and powdery alloy components attached by diffusion to part of the surface of the iron powder particles, said alloy components containing Ni and at least one of Mo and W, and said alloy being composed of 0.50–3.50 wt. % of Ni, 0.65–3.50 wt. % of Mo+$\frac{1}{2}$W, and the remainder of Fe and inevitable impurities, with the content of Ni and the content of Mo+$\frac{1}{2}$W in the steel powder of particle diameter smaller than 45 μm being in the range of 2.0–4.2 times the average content in the entire steel powder.

(2) A high-strength sintered alloy steel containing, as the alloy components in the final product, Ni and at least one of Mo and W, said alloy being composed of 0.50–3.50 wt. % of Ni, 0.65–3.50 wt. % of Mo+$\frac{1}{2}$W, and the remainder of Fe, C, and inevitable impurities, and having a density higher than 7.0 g/cm$^3$ and a tensile strength higher than 130 kgf/mm$^2$ after carburizing quenching and tempering.

(3) A high-strength high-toughness sintered alloy steel containing, as the alloy components in the final product, C, Ni, and at least one of Mo and W, said alloy being composed of 0.3–0.8 wt. % of C, 0.50–3.50 wt. % of Ni, 0.65–3.50 wt. % of Mo+$\frac{1}{2}$W, and the remainder of Fe and inevitable impurities, and having a density higher than 7.0 g/cm$^3$ and a tensile strength higher than 130 kgf/mm$^2$ after quenching and tempering.

(4) A high-strength sintered alloy steel produced from the composite alloy steel powder defined in (1) above, said alloy steel containing, as the alloy components in the final product, Ni and at least one of Mo and W, said alloy being composed of 0.50–3.50 wt. % of Ni, 0.65–3.50 wt. % of Mo+$\frac{1}{2}$W, and the remainder of Fe, C, and inevitable impurities, and having a density higher than 7.0 g/cm$^3$ and a tensile strength higher than 130 kgf/mm$^2$ after carburizing quenching and tempering.

(5) A high-strength high-toughness sintered alloy steel produced from the composite alloy steel powder defined in (1) above, said alloy steel containing, as the alloy components in the final product, C, Ni, and at least one of Mo and W, said alloy being composed of 0.3–0.8 wt. % of C, 0.50–3.50 wt. % of Ni, 0.65–3.50 wt. % of Mo+$\frac{1}{2}$W, and the remainder of Fe and inevitable impurities, and having a density higher than 7.0 g/cm$^3$ and a tensile strength higher than 130 kgf/mm$^2$ after quenching and tempering.

The term "composite alloy steel powder" as used in the present invention means steel powder composed of iron powder particles and alloy elements (e.g., Ni, Mo, and W) attached by diffusion to part of the surface of the iron powder particles.

The following is the reason why the values are limited as mentioned above.

Ni: 0.50–3.50 wt. %

Ni dissolves in the Fe basic metal, forming a solid solution, thereby increasing the strength and toughness of the sintered body. With less than 0.50 wt. %, Ni does not contribute to the increase of strength through the promotion of a solid solution and the improvement of hardenability, nor does it improve the toughness of the matrix. With more than 3.50 wt. %, Ni forms an excessive amount of austenite phase, decreasing the strength.

Mo: 0.65–3.50 wt. %

Mo dissolves in the Fe basic metal, forming a solid solution, thereby strengthening the sintered body, and forms a carbide to increase the strength and hardness, and also improves the hardenability. With less than 0.65 wt. %, Mo does not contribute to the increase of strength through the promotion of a solid solution and the improvement of hardenability. With more than 3.50 wt. %, Mo adversely affects the toughness. Mo provides a high strength when its content is more than 0.65 wt. %, and it provides a much higher strength when its content is more than 0.85 wt. %.

Mo as the basic alloy component may be partly or entirely replaced by twice as much (by weight) W as Mo. The reason why twice as much W as Mo is used is that W is one half as effective as Mo in changing the properties of the sintered steel.

C: 0.3–0.8 wt. %

C is a cheap strengthening element. With less than 0.3 wt. %, C does not impart high strength (in terms of tensile strength higher than 130 kg/mm$^2$) to the heat-treated sintered body. C in an excess amount forms a carbide, decreasing the strength and toughness and forming austenite. Therefore, the content of C in the heat-treated sintered body should be 0.3 to 0.8 wt. %. According to the present inventors' investigation, C produces different effects depending on its amount as mentioned in the following.

To prepare various kinds of mixed steel powders, the composite alloy steel powder containing Ni and Mo in the above-specified amounts was incorporated with a different amount of graphite so that the final product contained 0.1 to 1.0 wt. % of C and also with 1 wt. % of zinc stearate as a lubricant. The resulting steel powder was molded and sintered, and the sintered body underwent oil quenching at 870° C. for 30 minutes and tempering at 180° C. for 60 minutes. The thus obtained heat treated sintered steel was tested for tensile strength and Charpy impact. The results are shown in FIGS. 3 and 4. It is noted that high strength and high toughness were obtained when the C content was in the range of 0.3 to 0.8 wt. %.

The addition of C can be accomplished in different manners depending on the intended use of the finished parts. In an instance, graphite powder is added to the alloy steel powder at the time of sintering, and in another instance, carburizing quenching is performed after sintering. In the latter case, the C content may vary along the cross-section of the part; but it is not always necessary that the C content should be in the above-mentioned range all over the cross-section. It is only necessary that the carburized part should contain as much C as specified.

For the sintered products to have a high density, it is necessary that the alloy steel powder as the raw material should have a high compressibility. This requirement is met with the so called composite alloy steel powder composed of iron powder particles and powders of Ni and Mo and/or W attached by diffusion to the surfaces of the iron powder particles. By contrast, completely uniform pre-alloy steel powder is not adequate to make high-density sintered products because usually it has low compressibility.

In the case of a powder mixture composed of ordinary iron powder, Ni powder and Mo powder and/or W powder, the resulting sintered body does not have sufficient strength because the alloy elements do not diffuse completely during sintering. Even in the case of composite alloy steel powder, the resulting sintered body lacks strength unless the diffusion alloying takes place completely. The degree of diffusion alloying is indicated by "the degree of diffusion segregation" as an index. It is expressed by the ratio of the content of Ni or Mo+$\frac{1}{2}$W in the alloy steel powder of particle size smaller than 45 μm to the average content of Ni or Mo+$\frac{1}{2}$W in the entire steel powder, respectively.

If the degree of diffusion segregation is higher than 4.2 for Ni or Mo+$\frac{1}{2}$W, the resulting heat-treated sintered body has low strength and compressibility. On the other hand, if the degree of diffusion segregation is smaller than 2.0, the resulting heat-treated sintered body lacks sufficient compressibility and tensile strength because austenite does not change into martensite through the strain-induced transformation. Therefore, the degree of diffusion segregation should be in the range of 2.0 to 4.2. This is achieved by controlling the particle size of the iron powder and alloy components and also by controlling the heating temperatures.

The composite alloy steel powder should be composed of 0.50–3.50 wt. % of Ni, 0.65–3.50 wt. % of Mo+$\frac{1}{2}$W, and the remainder of Fe and inevitable impurities, according to the desired composition of the sintered body.

Impurities are permissible in the range shown below.

C: less than 0.03 wt. %, preferably less than 0.01 wt. %.

Si: less than 0.1 wt. %, preferably less than 0.05 wt. %.

Mn: less than 0.4 wt. %, preferably less than 0.15 wt. %.

Cr: less than 0.3 wt. %.

Cu: less than 0.3 wt. %.

Al: less than 0.1 wt. %.

P: less than 0.02 wt. %.

S: less than 0.02 wt. %.

O: less than 0.25 wt. %, preferably less than 0.15 wt. %.

N: less than 0.01 wt. %, preferably less than 0.002 wt. %.

It is not necessarily desirable to lower the content of Mn and Cr excessively, because they rather increase strength so long as their content is within the permitted limits.

For the sintered body to have a desired strength, the composite alloy steel powder should have such a particle size that the fraction of the powder having a particle size larger than 180 μm accounts for less than 10 wt. %.

According to the present invention, the sintered body undergoes heat treatment so that the final product has a high strength. In the case where it is desirable that the final product should have a high hardness in the vicinity of the surface, the sintered body undergoes carburizing quenching and tempering. In the case where it is desirable that the final product should have a uniform strength, the composite alloy steel powder is incorporated with graphite at the time of sintering and the sintered body undergoes ordinary quenching and tempering.

The heat treatment forms the texture of tempered martensite which is responsible for high strength and high toughness. The quenching temperature should preferably be 800°–930° C. With lower than 800° C., the quenching does not provide the uniform structure of austenite, and the final product lacks sufficient strength and toughness. With higher than 930° C., the quenching provides coarse austenite, and the final product lacks strength and toughness.

The tempering temperature should preferably be 100°–250° C. Tempering at temperatures lower than 100° C. will not provide sufficient toughness. Tempering at temperatures higher than 250° C. will not provide sufficient strength. The molding and sintering may be repeated more than once to increase the density. This may be accomplished by a recompression method which involves the steps of molding, sintering, and coining (sizing), or the steps of molding, preliminary sintering, coining (sizing), and final sintering.

Figure 1:
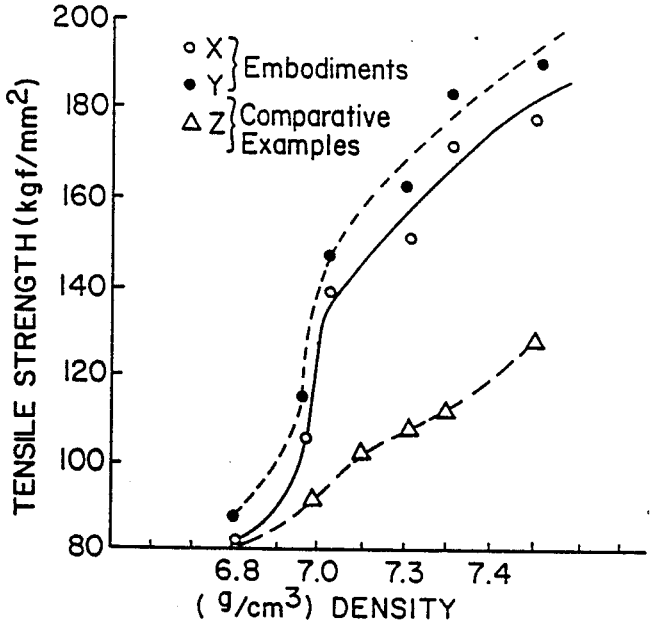
FIG. 1 is a graph showing the relation between the density and the tensile strength of the heat-treated sintered bodies of different compositions.
Figure 2:
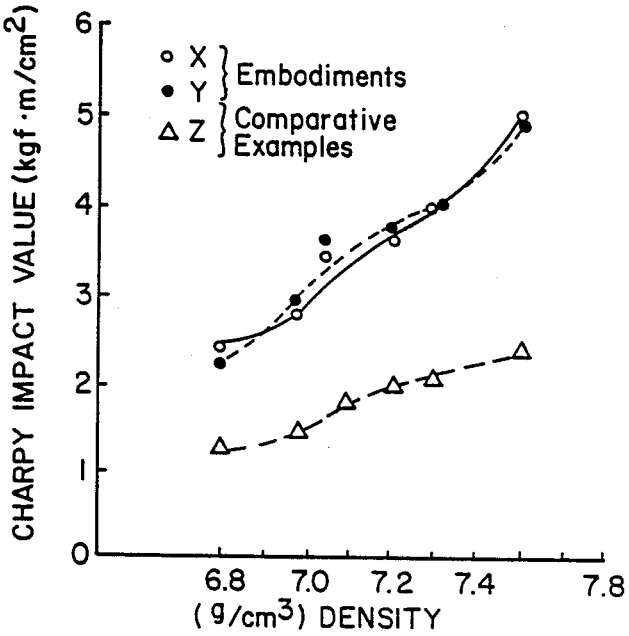
FIG. 2 is a graph showing the relation between the density and the Charpy impact value of the same heat-treated sintered bodies as shown in FIG. 1.
Figure 3:
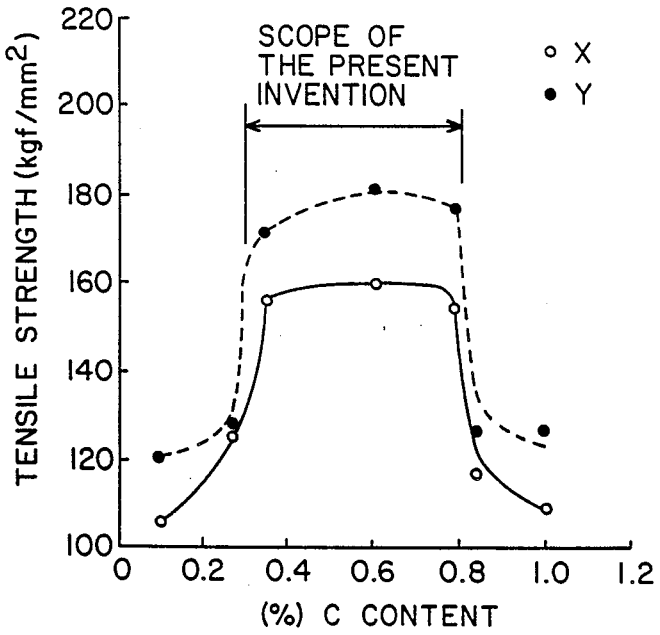
FIG. 3 is a graph showing the relation between the C content and the tensile strength of the heat-treated sintered bodies containing Ni and Mo in amounts within the limit specified in the present invention.
Figure 4:
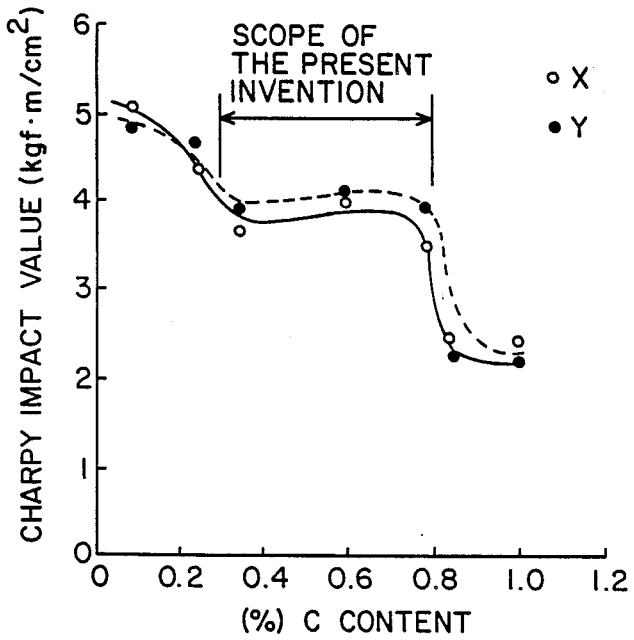
FIG. 4 is a graph showing the relation between the C content and the Charpy impact value of the same heat-treated sintered bodies as shown in FIG. 3.

Best Mode for Carrying Out the Invention

Examples 1 to 3 and Comparative Examples 1 to 3

The composite alloy steel powder as the starting material was produced in the following manner.

Atomized pure iron powder (under 80 mesh), nickel oxide powder (under 325 mesh), and molybdenum trioxide powder (under 325 mesh) were mixed according to the prescribed formulation. The mixture was heated at 800° C. for 120 minutes in hydrogen gas for the reduction of nickel oxide and molybdenum trioxide. Thus there was obtained composite alloy steel powder composed of iron powder particles and Ni and Mo attached by diffusion to the surface of the iron powder particles.

To examine the effect of "the degree of diffusion segregation," different kinds of composite alloy steel powders were prepared by mixing the above-mentioned pure iron powder, metallic Ni powder (under 325 mesh), and metallic Mo powder (under 325 mesh) and then heating the resulting mixture at 700° C., 750° C., 800° C., 850° C., and 1050° C. in hydrogen gas.

These composite alloy steel powders were found to have the following compositions.

Ni: 2.10–2.18 wt. %
Mo: 1.12–1.23 wt. %
C: 0.002 wt. %
Si: 0.04 wt. %
Mn: 0.07 wt. %
Cu: 0.01 wt. %
P: 0.006 wt. %
S: 0.006 wt. %
O: 0.07–0.13 wt. %
N: 0.0007–0.0019 wt. %

All of the alloy steel powders were found to contain 0.9–2.5 wt. % of particles larger than 180 μm in particle diameter.

After the addition of 0.9 wt. % of zinc stearate as a lubricant, the alloy steel powder was made into a sintered body having a density of 7.28–7.51 g/cm$^3$ by the steps of molding under a pressure of 7 tons/cm$^2$, preliminary sintering in hydrogen gas at 900° C. for 30 minutes, coining under a pressure of 7 tons/cm$^2$, and final sintering in hydrogen gas at 1250° C. for 90 minutes.

The thus obtained sintered body was carburized with carbon potential of 0.8 wt. % at 900° C. for 6.5 hours, immediately followed by oil quenching, and tempered at 180° C. for 120 minutes. Strength was measured using a tensile test piece having a parallel part 5 mm in diameter. The results are shown in Table 1. It is noted from Table 1 that the sintered bodies have a high strength so long as the degree of diffusion segregation is in the range of 2.0–4.2.

TABLE 1

| | Composite alloy steel powder | | | | | Sintered body | | | Carburized and quenched material |
|---|---|---|---|---|---|---|---|---|---|
| Example No. | Ni Source | Mo source | Heating temp (°C.) | DDS(*) of Ni | DDS(*) of Mo | Content of Ni (%) | Content of Mo (%) | Density (g/cm$^3$) | Tensile strength (kgf/mm$^2$) |
| 1 | Nickel Oxide | Molybdenum trioxide | 800 | 3.47 | 3.29 | 2.15 | 1.18 | 7.49 | 153 |
| 2 | Metallic Nickel | Metallic molybdenum | 800 | 4.16 | 3.29 | 2.16 | 1.23 | 7.50 | 139 |
| 3 | Metallic Nickel | Metallic molybdenum | 850 | 3.85 | 3.62 | 2.13 | 1.20 | 7.51 | 148 |
| (1) | Metallic Nickel | Metallic molybdenum | 700 | 4.86 | 4.22 | 2.10 | 1.12 | 7.45 | 128 |
| (2) | Metallic Nickel | Metallic molybdenum | 750 | 4.27 | 4.01 | 2.18 | 1.16 | 7.48 | 129 |
| (3) | Metallic | metallic | 1050 | 1.82 | 1.81 | 2.11 | 1.20 | 7.28 | 108 |

TABLE 1-continued

| Example No. | Composite alloy steel powder: Ni Source | Mo source | Heating temp (°C.) | DDS(*) of Ni | DDS(*) of Mo | Sintered body: Content of Ni (%) | Content of Mo (%) | Density (g/cm³) | Carburized and quenched material: Tensile strength (kgf/mm²) |
|---|---|---|---|---|---|---|---|---|---|
| | Nickel | molybdenum | | | | | | | |

*Degree of diffusion segregation
Parenthesized numbers indicate Comparative Examples.

Examples 4 to 16 and Comparative Examples 4 to 6

Fifteen kinds of composite alloy steel powders containing different amounts of Ni, Mo, and/or W as shown in Table 2 were prepared from atomized pure iron powder, nickel oxide powder, and molybdenum trioxide powder. The mixture was heated at 800° C. for reduction. In addition, an alloy steel powder containing Ni, Mo, and Cu was prepared by heating at 850° C. (Comparative Example 6). All of the alloy steel powders were found to contain 0.5–3.0 wt. % of particles larger than 180 μm in particle diameter. The alloy steel powders underwent sintering, carburizing and quenching, and tempering under the same conditions as in Examples 1 to 3. The results are shown in Table 2. It is noted from Table 2 that the sintered bodies had a tensile strength higher than 130 kgf/mm² so long as the Ni content was 0.50–3.50 wt. % and the Mo content was 0.65–3.50 wt. % and the degree of diffusion segregation was adequate. Desirable results were obtained particularly in the case where the Mo content was higher than 0.85 wt. %.

Examples 17 to 24 and Comparative Example 7

The relation between the sintering density and the tensile strength was examined.

The experiments were carried out with the composite alloy steel powder (2.15% Ni - 1.18% Mo) prepared in Example 1. The alloy steel powder, with or without graphite added, and with 0.9 wt. % of zinc stearate added, underwent the primary molding (ordinary forming) under a prescribed pressure. The compact underwent the primary sintering (preliminary sintering or ordinary sintering) in hydrogen gas at a prescribed temperature for 60 minutes. In some cases, the sintered body underwent the secondary forming (coining or sizing) under a prescribed pressure. In some other cases, the sintered body underwent the secondary sintering (final sintering) in hydrogen gas at 1300° C. for 60 minutes. The sintered body underwent carburizing and quenching, and tempering under the same conditions as in Example 1. The specimens were tested for tensile strength. The results are shown in Table 3. It is noted from Table 3 that the sintered bodies have a tensile strength higher than 130 kgf/mm² so long as their density is higher than 7.0 g/cm³, preferably 7.3 g/cm³.

TABLE 2

| Example No. | Composite alloy steel powder: Ni source | Mo source | W or Cu source | Heating Temp. (°C.) | DDS (*) of Ni | DDS (*) of Mo + ½W | Sintered body: Content of Ni (%) | Content of Mo (%) | Content of W (%) | Content of Cu (%) | Density (g/cm³) | Carburized and quenched material: Tensile strength (kgf/mm²) |
|---|---|---|---|---|---|---|---|---|---|---|---|---|
| 4 | NiO | $MoO_3$ | — | 800 | 3.39 | 3.17 | 0.52 | 1.09 | — | — | 7.54 | 135 |
| 5 | NiO | $MoO_3$ | — | 800 | 3.44 | 3.31 | 0.98 | 1.17 | — | — | 7.52 | 138 |
| 6 | NiO | $MoO_3$ | — | 800 | 3.43 | 3.28 | 1.92 | 1.18 | — | — | 7.50 | 155 |
| 7 | NiO | $MoO_3$ | — | 800 | 3.56 | 3.19 | 2.96 | 1.03 | — | — | 7.47 | 152 |
| 8 | NiO | $MoO_3$ | — | 800 | 3.60 | 3.33 | 3.12 | 1.08 | — | — | 7.47 | 147 |
| 9 | NiO | $MoO_3$ | — | 800 | 3.47 | 3.30 | 2.01 | 0.67 | — | — | 7.49 | 133 |
| 10 | NiO | $MoO_3$ | — | 800 | 3.42 | 3.37 | 2.01 | 0.83 | — | — | 7.48 | 135 |
| 11 | NiO | $MoO_3$ | — | 800 | 3.49 | 3.21 | 1.89 | 0.86 | — | — | 7.49 | 148 |
| 12 | NiO | $MoO_3$ | — | 800 | 3.53 | 3.23 | 2.07 | 1.46 | — | — | 7.48 | 152 |
| 13 | NiO | $MoO_3$ | — | 800 | 3.54 | 3.24 | 2.16 | 1.95 | — | — | 7.46 | 148 |
| 14 | NiO | $MoO_3$ | — | 800 | 3.46 | 3.39 | 1.89 | 2.43 | — | — | 7.46 | 135 |
| 15 | NiO | $MoO_3$ | $WO_3$ | 800 | 3.36 | 3.31 | 1.90 | 1.13 | 2.51 | — | 7.43 | 141 |
| 16 | NiO | — | $WO_3$ | 800 | 3.20 | 3.15 | 1.93 | — | 4.90 | — | 7.44 | 137 |
| (4) | NiO | $MoO_3$ | — | 800 | 3.37 | 3.22 | 0.47 | 1.14 | — | — | 7.54 | 122 |
| (5) | NiO | $MoO_3$ | — | 800 | 3.55 | 3.25 | 1.97 | 0.62 | — | — | 7.49 | 121 |
| (6) | NiO | $MoO_3$ | Cu | 800 | 3.10 | 3.14 | 1.95 | 0.60 | — | 0.72 | 7.51 | 103 |

*Degree of diffusion segregation
Parenthesized numbers indicate Comparative examples.

TABLE 3

| Example No. | Amount of graphite added (%) | Primary forming pressure (t/cm²) | Primary sintering temp. (°C.) | Secondary forming pressure (t/cm²) | Secondary sintering temp. (°C.) | Density (g/cm³) | Tensile strength (kgf/mm²) |
|---|---|---|---|---|---|---|---|
| (7) | 0 | 4 | 1300 | — | — | 6.97 | 125 |
| 17 | 0 | 4.5 | 1300 | — | — | 7.04 | 136 |
| 18 | 0 | 6 | 1300 | — | — | 7.17 | 139 |
| 19 | 0 | 6.5 | 1300 | — | — | 7.23 | 146 |
| 20 | 0 | 7 | 1300 | — | — | 7.31 | 152 |

TABLE 3-continued

| Example No. | Amount of graphite added (%) | Primary forming pressure (t/cm²) | Primary sintering temp. (°C.) | Secondary forming pressure (t/cm²) | Secondary sintering temp. (°C.) | Density (g/cm³) | Tensile strength (kgf/mm²) |
|---|---|---|---|---|---|---|---|
| 21 | 0 | 7 | 1300 | 7 | 1300 | 7.42 | 157 |
| 22 | 0.3 | 6 | 880 | 7 | 1300 | 7.54 | 160 |
| 23 | 0.3 | 6 | 880 | 9.5 | 1300 | 7.64 | 153 |
| 24 | 0 | 7 | 820 | 9.5 | 1300 | 7.60 | 151 |

Parenthesized numbers indicate Comparative Examples.

Examples 25 to 31 and Comparative Examples 8 to 14

Composite alloy steel powders having a particle size of 80 mesh or less were prepared in the following manner from water-atomized pure iron powder, carbonyl nickel powder, molybdenum trioxide ($MoO_3$) powder, and tungsten trioxide ($WO_3$) powder. All of the alloy component powders had a particle size of 325 mesh or under. The iron powder had the following chemical composition.

C: 0.002 wt. %
Si: 0.03 wt. %
Mn: 0.04 wt. %
Cu: 0.01 wt. %
P: 0.005 wt. %
S: 0.007 wt. %
O: 0.086 wt. %
N: 0.0008 wt. %

The iron powder and the alloy component powders were uniformly mixed according to the prescribed formulation to be shown later. The mixture was heated in a hydrogen gas atmosphere at 850° C. for 60 minutes, so that the alloy element powders attached by diffusion to parts of the surfaces of the iron powder particles. The resulting product was crushed to give the composite alloy steel powder.

The alloy steel powder was incorporated with 1 wt. % of zinc stearate and then formed under a pressure of 6 tons/cm². The compact was sintered in an ammonia decomposition gas at 1250° C. for 60 minutes. To examine the workability before heat treatment, the sintered body was tested for tensile strength.

The sintered body underwent heat treatment which includes carburizing with carbon potential of 0.85% at 880° C. for 200 minutes and oil quenching and tempering at 180° C. for 60 minutes. The heat-treated specimen was tested for tensile strength as an index of strength.

The compositions of the composite alloy steel powders are shown in Table 4. The composite alloy steel powders in Examples 25 to 31 and Comparative Examples 8 to 13 had the composition which is within or close to the range specified in the present invention. The composite alloy steel powder in Comparative Example 14 had the conventional standard composition.

The composite alloy steel powders were evaluated. The results are shown in Table 5. For the composite alloy steel powder to be useful for high-density sintered bodies, it should have such compressibility that the compact has a density of about 7.05 g/cm³ when formed under a pressure of 6 tons/cm². The composite alloy steel powder with a high Mo content and low Ni content according to the present invention provides sintered bodies having a tensile strength of 107–126 kgf/mm² when formed under a pressure of 6 tons/cm². The sintered body before heat treatment can undergo machining and sizing without difficulties if it has a tensile strength lower than about 40 kgf/mm².

TABLE 4

| Example No. | Composite alloy Steel Powder: Content of Ni (wt %) | Content of Mo (wt %) | Content of W (wt %) | Content of Cu (wt %) | Content of Mo + ½W (wt %) | DDS(*) of Ni | DDS(*) of Mo + ½W |
|---|---|---|---|---|---|---|---|
| 25 | 1.10 | 1.07 | — | — | 1.07 | 3.26 | 3.25 |
| 26 | 1.98 | 0.99 | — | — | 0.99 | 3.20 | 3.18 |
| 27 | 3.34 | 0.97 | — | — | 0.97 | 2.99 | 3.03 |
| 28 | 2.60 | 0.99 | — | — | 0.99 | 3.41 | 3.29 |
| 29 | 1.59 | 2.25 | — | — | 2.25 | 3.32 | 3.40 |
| 30 | 1.56 | 1.76 | 0.85 | — | 2.18 | 3.66 | 3.54 |
| 31 | 2.02 | — | 1.85 | — | 0.92 | 2.52 | 2.49 |
| (8) | 0.33 | 0.49 | — | — | 0.49 | 2.91 | 2.93 |
| (9) | 0.23 | 0.95 | — | — | 0.95 | 2.88 | 2.86 |
| (10) | 0.36 | 1.01 | — | — | 1.01 | 2.92 | 3.04 |
| (11) | 1.66 | 0.24 | — | — | 0.24 | 3.07 | 3.00 |
| (12) | 1.71 | 0.35 | — | — | 0.35 | 3.54 | 3.59 |
| (13) | 1.60 | 3.60 | — | — | 3.60 | 3.72 | 3.90 |
| (14) | 4.31 | 0.53 | — | 1.52 | 0.53 | 3.98 | 3.94 |

*Degree of diffusion segregation
Parenthesized numbers indicate Comparative Examples.

TABLE 5

| Example No. | Density (g/cm³) | Tensile strength (kgf/mm²) of sintered body* | Tensile strength (kgf/mm²) after heat treatment |
|---|---|---|---|
| 25 | 7.10 | 26[35] | 107 |
| 26 | 7.11 | 32[38] | 121 |
| 27 | 7.11 | 37[43] | 116 |
| 28 | 7.09 | 48[57] | 115 |
| 29 | 7.09 | 30[45] | 126 |
| 30 | 7.11 | 30[44] | 123 |
| 31 | 7.13 | 29[37] | 125 |
| (8) | 7.12 | 18[25] | 79 |
| (9) | 7.11 | 20[31] | 88 |
| (10) | 7.11 | 21[33] | 102 |
| (11) | 7.12 | 29[30] | 87 |
| (12) | 7.11 | 27[33] | 109 |
| (13) | 7.03 | 37[63] | 95 |
| (14) | 7.09 | 52[66] | 106 |

*Brackets indicate values in the case where 0.15% of graphite is added.
Parenthesized numbers indicate Comparative Examples.

Examples A to E and Comparative Examples F to K

Composite alloy steel powders were prepared from iron powder (80 mesh or less), nickel powder (325 mesh or less), and molybdenum oxide ($MoO_3$) powder (325 mesh or less) in a prescribed ratio, by heating for reduction in a hydrogen gas atmosphere at 1000° C. for 1 hour, annealing, and crushing. The thus formed composite alloy steel powders had the chemical composition and the degree of diffusion segregation as shown in Table 6.

After the addition of 0.75 wt. % of graphite and 1 wt. % of zinc stearate as a lubricant, each of the composite alloy steel powders was formed under a pressure of 7 tons/cm$^2$. The compact was sintered in an ammonia decomposition gas at 850° C. for 30 minutes. The sintered body underwent compression forming again under a pressure of 7 tons/cm$^2$. The compact was sintered again in an ammonia decomposition gas at 1250° C. for 30 minutes. The thus obtained sintered body was heated in an inert gas at 870° C. for 60 minutes, followed by oil quenching. The sintered body further underwent quenching and tempering by heating in an oil bath at 180° C. for 60 minutes and air cooling. The sintered body was finally tested for tensile strength and Charpy impact strength. The sintered body had the chemical composition, density, tensile strength, and impact value as shown in Table 7.

It is noted from Table 7 that the sintered bodies have a tensile strength higher than 150 kgf/mm$^2$ and a Charpy impact value higher than 4 kgf.m/cm$^2$ if they have the chemical composition and density as specified in the present invention.

Examples L to P and Comparative Examples Q to V

After the addition of 0.75 wt. % of graphite and 1 wt. % of zinc stearate as a lubricant, each of the composite alloy steel powders shown in Table 6 was formed under a pressure of 7 tons/cm$^2$. The compact was sintered in an ammonia decomposition gas at 1250° C. for 30 minutes. The sintered body was heated in an inert gas at 870° C. for 60 minutes, followed by oil quenching. The sintered body further underwent quenching and tempering by heating in an oil bath at 180° C. for 60 minutes and air cooling. The sintered body was finally tested for tensile strength and Charpy impact strength. The results are shown in Table 8. It is noted from Table 8 that the sintered bodies have a tensile strength higher than 130 kgf/mm$^2$ and a Charpy impact value higher than 3.5 kgf.m /cm$^2$ if they have the chemical composition as specified in the present invention.

TABLE 6

| Chemical Composition of Composite Alloy Steel Powder | | | | |
|---|---|---|---|---|
| Designation | Content of Ni (wt %) | Content of Mo (wt %) | DDS* of Ni | DDS* of Mo |
| Example A (L) | 0.58 | 3.21 | 3.39 | 3.20 |
| Example B (M) | 1.07 | 3.42 | 3.41 | 3.25 |
| Example C (N) | 2.13 | 1.01 | 3.56 | 3.27 |
| Example D (O) | 2.96 | 2.14 | 3.51 | 3.21 |
| Example E (P) | 3.45 | 0.72 | 3.50 | 3.41 |
| Comparative Example F (Q) | 1.09 | 0.60 | 3.39 | 3.18 |
| Comparative Example G (R) | 3.59 | 3.68 | 3.41 | 3.27 |
| Comparative Example H (S) | 0.46 | 4.00 | 3.60 | 3.32 |
| Comparative Example I (T) | 3.67 | 1.03 | 3.48 | 3.29 |
| Comparative Example J (U) | 3.71 | 3.69 | 3.58 | 3.27 |
| Comparative Example K (V) | 0.42 | 0.50 | 3.54 | 3.24 |

*Degree of diffusion segregation

TABLE 7

| Chemical Composition and Mechanical Properties of Sintered Body | | | | | | |
|---|---|---|---|---|---|---|
| Designation | C (wt %) | Ni (wt %) | Mo (wt %) | Density (g/cm$^3$) | Tensile strength (kgf/mm$^2$) | Impact value (kgf.m/cm$^2$) |
| Example A | 0.64 | 0.57 | 3.21 | 7.42 | 172 | 4.0 |
| Example B | 0.63 | 1.09 | 3.40 | 7.42 | 184 | 4.1 |
| Example C | 0.64 | 2.13 | 1.00 | 7.43 | 192 | 4.9 |
| Example D | 0.67 | 2.94 | 2.10 | 7.46 | 198 | 5.2 |
| Example E | 0.65 | 3.43 | 0.71 | 7.41 | 162 | 5.6 |
| Comparative Example F | 0.68 | 1.07 | 0.62 | 7.40 | 111 | 2.1 |
| Comparative Example G | 0.65 | 3.58 | 3.68 | 7.41 | 116 | 2.5 |
| Comparative Example H | 0.65 | 0.46 | 4.00 | 7.43 | 106 | 1.9 |
| Comparative Example I | 0.64 | 3.70 | 1.02 | 7.40 | 102 | 2.8 |
| Comparative Example J | 0.63 | 3.69 | 3.67 | 7.41 | 124 | 2.6 |
| Comparative Example K | 0.66 | 0.40 | 0.49 | 7.40 | 96 | 2.7 |

TABLE 8

| Chemical Composition and Mechanical Properties of Sintered Body | | | | | | |
|---|---|---|---|---|---|---|
| Designation | C (wt %) | Ni (wt %) | Mo (wt %) | Density (g/cm$^3$) | Tensile strength (kgf/mm$^2$) | Impact value (kgf.m/cm$^2$) |
| Example L | 0.65 | 0.54 | 3.20 | 7.12 | 140 | 3.5 |
| Example M | 0.63 | 1.03 | 3.39 | 7.12 | 149 | 3.8 |
| Example N | 0.62 | 2.10 | 1.04 | 7.15 | 147 | 3.2 |
| Example O | 0.70 | 2.92 | 2.12 | 7.18 | 148 | 3.1 |
| Example P | 0.68 | 3.42 | 0.70 | 7.19 | 133 | 3.2 |
| Comparative Example Q | 0.66 | 1.07 | 0.60 | 7.22 | 102 | 1.8 |

TABLE 8-continued

| Chemical Composition and Mechanical Properties of Sintered Body | | | | | | |
|---|---|---|---|---|---|---|
| Designation | C (wt %) | Ni (wt %) | Mo (wt %) | Density ($g/cm^3$) | Tensile strength ($kgf/mm^2$) | Impact value ($kgf.m/cm^2$) |
| Comparative Example R | 0.63 | 3.62 | 3.67 | 7.18 | 94 | 2.1 |
| Comparative Example S | 0.65 | 0.42 | 4.02 | 7.21 | 90 | 1.8 |
| Comparative Example T | 0.64 | 3.65 | 1.00 | 7.22 | 92 | 2.4 |
| Comparative Example U | 0.66 | 3.67 | 3.66 | 7.20 | 112 | 2.3 |
| Comparative Example V | 0.67 | 0.41 | 0.48 | 7.22 | 85 | 2.0 |

Exploitation in Industry

As mentioned above, the heat-treated sintered steel of the present invention has both an extremely high strength and an extremely high toughness. Therefore, it is useful as sintered parts which need high strength and high toughness. The alloy steel powder of the present invention meets the requirement for sintered parts having high strength. It exhibits outstanding properties in the case where both high density and workability are required. Therefore, it is expected to permit the easy production by powder metallurgy of mechanical parts of complex shape to be used under high loads.

We claim:

1. A composite alloy steel powder for powder metallurgy composed of iron powder particles and powdery alloy components attached by diffusion to parts of the surfaces of the iron powder particles, which comprises Ni and Mo as alloy components, said alloy powder comprising 0.05–3.50 wt. % of Ni, 0.65–3.50 wt. % of Mo, and the remainder of Fe and inevitable impurities, wherein the content of Ni and the content of Mo in the particles of alloy steel powder which have particle diameters smaller than 45 μm are in the range of 2.0–4.2 times the average content of Ni and of Mo in the entire alloy steel powder.

2. A high-strength sintered alloy steel which comprises Ni and Mo together with Fe as alloy components in the final product, said alloy steel being composed of 0.50–3.50 wt. % of Ni, 0.65–3.50 wt. % of Mo, and the remainder of Fe, C, and inevitable impurities, and said sintered alloy steel having a density higher than 7.09 $g/cm^3$ and a tensile strength higher than 130 $kgf/mm^2$ after quenching and tempering.

3. A high-strength high-toughness sintered alloy steel which comprises C, Ni and Mo as alloy components together with Fe in the final product, said alloy being composed of 0.3–0.8 wt. % of C, 0.50–3.50 wt. % of Ni, 0.65–3.50 wt. % of Mo, and the remainder of Fe and inevitable impurities, and said alloy steel having a density higher than 7.0 $g/cm^3$ and a tensile strength higher than 130 $kgf/mm^2$ after quenching and tempering.

4. A high-strength sintered alloy steel produced from the composite alloy steel powder defined in claim 1, which comprises Fe and Ni and Mo as alloy components in the final product, said alloy being composed of 0.50–3.50 wt. % of Ni, 0.65–3.50 wt. % of Mo, and the remainder of Fe, C, and inevitable impurities, and said alloy steel having a density higher than 7.0 $g/cm^3$ and a tensile strength higher than 130 $kgf/mm^2$ after carburizing quenching and tempering.

5. A high-strength high-toughness sintered alloy steel produced from the composite alloy steel powder defined in claim 1, which comprises Fe, C, Ni, and Mo as alloy components in the final product, said alloy steel being composed of 0.3–0.8 wt. % of C, 0.50–3.50 wt. % of Ni, 0.65–3.50 wt. % of Mo, and the remainder of Fe and inevitable impurities, and said alloy steel having a density higher than 7.0 $g/cm^3$ and a tensile strength higher than 130 $kgf/mm^2$ after quenching or tempering.

6. A composite alloy steel powder for powder metallurgy composed of iron powder particles and powdery alloy components attached by diffusion to parts of the surfaces of the iron powder particles, which powder comprises Ni, Mo, and W as alloy components, said alloy being composed of 0.50–3.50 wt. % of Ni, 0.65–3.50 wt. % of $Mo+\frac{1}{2}W$, and the remainder of Fe and inevitable impurities, wherein the content of Ni and the content of $Mo+\frac{1}{2}W$ in steel powder having particle diameters smaller than 45 μm are in the range of 2.0–4.2 times the average content of Ni and of $Mo+\frac{1}{2}W$ in the entire steel powder.

7. A high-strength sintered alloy steel which comprises Fe together with Ni, Mo, and W as alloy components in the final product, said alloy being composed of 0.50–3.50 wt. % of Ni, 0.65–3.50 wt. % of $Mo+\frac{1}{2}W$, and the remainder of Fe, C, and inevitable impurities, and said alloy steel having a density higher than 7.0 $g/cm^3$ and a tensile strength higher than 130 $kgf/mm^2$ after carburizing quenching and tempering.

8. A high-strength high-toughness sintered alloy steel which comprises Fe together with C, Ni, Mo, and W as alloy components in the final product, said alloy being composed of 0.3–0.8 wt. % of C, 0.50–3.50 wt. % of Ni, 0.65–3.50 wt. % of $Mo+\frac{1}{2}W$, and the remainder of Fe and inevitable impurities, and said alloy steel having a density higher than 7.0 $g/cm^3$ and a tensile strength higher than 130 $kgf/mm^2$ after quenching and tempering.

9. A high-strength sintered alloy steel produced from the composite alloy steel powder defined in claim 6, which comprises Ni, Mo, and W as alloy components in the final product, said alloy being composed of 0.50–3.50 wt. % of Ni, 0.65–3.50 wt. % of $Mo+\frac{1}{2}W$, and the remainder of Fe, C, and inevitable impurities, and said alloy steel having a density higher than 7.0 $g/cm^3$ and a tensile strength higher than 130 $kgf/mm^2$ after carburizing quenching and tempering.

10. A high-strength high-toughness sintered alloy steel produced from the composite alloy steel powder defined in claim 6, which comprises C, Ni, Mo, and W as alloy components in the final product, said alloy being composed of 0.3–0.8 wt. % of C, 0.50–3.50 wt. % of Ni, 0.65–3.50 wt. % of $Mo+\frac{1}{2}W$, and the remainder of Fe and said alloy steel inevitable impurities, and having a density higher than 7.0 $g/cm^3$ and a tensile strength higher than 130 $kgf/mm^2$ after quenching and tempering.

11. A composite alloy steel powder for powder metallurgy composed of iron powder particles and powdery alloy components attached by diffusion to parts of the surfaces of the iron powder particles, which powder comprises Ni and W as alloy components, said alloy being composed of 0.50–3.50 wt. % of Ni, 1.30–7.00 wt.

% of W, and the remainder of Fe and inevitable impurities, wherein the content of Ni and the content of W in the steel powder which have particle diameters smaller than 45 μm being in the range of 2.0–4.2 times the average content of Ni and W in the entire steel powder.

12. A high-strength sintered alloy steel which comprises Ni and W along with Fe as alloy components in the final product, said alloy being composed of 0.50–3.50 wt. % of Ni, 1.30–7.00 wt. % of W, and the remainder of Fe, C and inevitable impurities, and said alloy steel having a density higher than 7.0 g/cm$^3$ and a tensile strength higher than 130 kgf/mm$^2$ after carburizing quenching and tempering.

13. A high-strength high-toughness sintered alloy steel which comprises C, Ni, and W along with Fe as alloy components in the final product, said alloy steel being composed of 0.3–0.8 wt. % of C, 0.50–3.50 wt. % of Ni, 1.30–7.00 wt. % of W, and the remainder of Fe and inevitable impurities, and said alloy steel having a density higher than 7.0 g/cm$^3$ and a tensile strength higher than 130 kgf/mm$^2$ after quenching and tempering.

14. A high-strength sintered alloy steel produced from the composite alloy steel powder defined in claim 11, which comprises Fe together with Ni and W as alloy components in the final product, said alloy being composed of 0.50–3.50 wt. % of Ni, 1.30–7.00 wt. % of W, and the remainder of Fe, C and inevitable impurities, and said alloy steel having a density higher than 7.0 g/cm$^3$ and a tensile strength higher than 130 kgf/mm$^2$ after carburizing quenching and tempering.

15. A high-strength high-toughness sintered alloy steel produced from the composite alloy steel powder defined in claim 11, which comprises Fe together with Ni and W as the alloy components in the final product, said alloy steel being composed of 0.3–0.8 wt. % of C, 0.50–3.50 wt. % of Ni, 1.30–7.00 wt. % of W, and the remainder of Fe and inevitable impurities, and said alloy steel having a density higher than 7.0 g/cm$^3$ and a tensile strength higher than 130 kgf/mm$^2$ after quenching and tempering.

* * * * *